United States Patent [19]

Aikens

[11] 4,266,839

[45] May 12, 1981

[54] ZERO INSERTION FORCE TOGGLE LINK CONNECTOR

[75] Inventor: Paul W. Aikens, Mechanicsburg, Pa.

[73] Assignee: E. I. Du Pont de Nemours and Company, Wilmington, Del.

[21] Appl. No.: 55,376

[22] Filed: Jul. 6, 1979

[51] Int. Cl.[3] ..... H01R 9/09; H01R 13/629

[52] U.S. Cl. ..... 339/75 MP; 339/17 L

[58] Field of Search ..... 339/17 L, 74 R, 75 M, 339/75 MP, 176 MP

[56] References Cited

U.S. PATENT DOCUMENTS

| | | | |
|---|---|---|---|
| 3,568,134 | 3/1971 | Anhalt et al. | 339/75 MP |
| 3,697,929 | 10/1972 | Konewko et al. | 339/176 MP X |
| 4,076,362 | 2/1978 | Ichimura | 339/75 MP |
| 4,119,357 | 10/1978 | Bonhomme | 339/75 MP |
| 4,189,199 | 2/1980 | Grau | 339/75 MP |

FOREIGN PATENT DOCUMENTS

| | | | |
|---|---|---|---|
| 2252670 | 6/1975 | France | 339/75 MP |

*Primary Examiner*—Eugene F. Desmond

[57] ABSTRACT

A progressively activated zero insertion force connector block having a toggle link actuating a plurality of spring terminals to alternately cause said springs to contact and release a circuit board. As the first spring terminal engages or disengages the circuit board, additional spring terminals in line are progressively actuated.

6 Claims, 13 Drawing Figures

10
12
13
14
18
20
22
38
40
42
50
A
B

ZERO INSERTION FORCE TOGGLE LINK CONNECTOR

DESCRIPTION

1. Technical Field

This invention relates to zero insertion force connector blocks. More particularly it refers to a progressively activated toggle link zero insertion force connector block having a pair of oppositely displaced rotating links actuating a plurality of spring terminals along both sides of a slot formed in a dielectric housing. In a first position the springs provide a strong electrical contact with the circuit board and in a second position permits the friction free removal of the board from the slot.

2. Background Art

Many attempts have been made to design a connector block which eliminates the friction and consequent wear on terminal strips caused by insertion and removal of a circuit board from its connector. U.S. Pat. No. Re. 29,223 uses inclined planes in the connector to effect a zero insertion force. U.S. Pat. No. 4,085,990 employs a cam follower engaged to the internal electrical contact. A printed circuit board can be inserted into this connector without engaging the contacts as each cam follower engages the high point of its associated cam surface.

U.S. Pat. No. 3,793,609 obtains low insertion force using an actuator to retract the contacts prior to insertion of a circuit board.

U.S. Pat. No. 3,744,005 employs a cam bar to engage each terminal serially and move the contact portions on the terminals into engagement with the circuit board contact. The following patents also employ various cam actions to achieve a zero insertion force connector:

U.S. Pat. No. 4,060,300
U.S. Pat. No. 4,050,758
U.S. Pat. No. 3,980,377
U.S. Pat. No. 4,118,094
U.S. Pat. No. 3,818,419
U.S. Pat. No. 4,077,688

A recent U.S. Pat. No. 4,119,357, employs differentially resilient portions on the spring terminals to achieve a zero insertion force. All of these inventions suffer from one or more of the following limitations:

(a) insufficient wiping movement on the contact surface,
(b) high inertial force needed to actuate the connector contacts,
(c) complex construction required for making connector block,
(d) inability to program, ground, power and signal terminals to actuate separately,
(e) inability to miniaturize connector block, and
(f) insufficient force on contact surface.

A zero insertion force connector is needed that will overcome these deficiencies.

SUMMARY OF THE INVENTION

This invention involves the discovery of a novel zero insertion force connector block which overcomes prior art deficiencies. The connector of this invention includes a two-piece dielectric housing molded from conventional dielectric plastic substances. The housing has an elongated slot of a size to receive the edge of a circuit board. The circuit board is guided into the interior of the housing by guiding members in the housing. One or a pair of toggle rods is positioned parallel to the slot in the housing. The toggle rod has in one embodiment a single elongated channel for receiving the rounded first end or bearing end of a spring. The first end of the spring is a curved bearing engaging the channel of the toggle rod. The intermediate portion of the spring is S-shaped with the outer surface of the upper loop being the contact surface with an electrical contact element in the circuit board. The second or bottom end of the spring is fixed within the bottom of the housing and serves as an electrical contact with another electrical device. Circular movements of the toggle rod cause the spring to engage and wipe the circuit board contact and reversing that circular movement causes the spring contact surface to disengage from the circuit board. The toggle rod action causes the spring to move over center so that it locks in the desired open or closed position.

BRIEF DESCRIPTION OF THE DRAWINGS

In the drawings wherein like reference characters denote corresponding parts throughout the several views.

DESCRIPTION OF THE PREFERRED EMBODIMENTS

Figure 1:
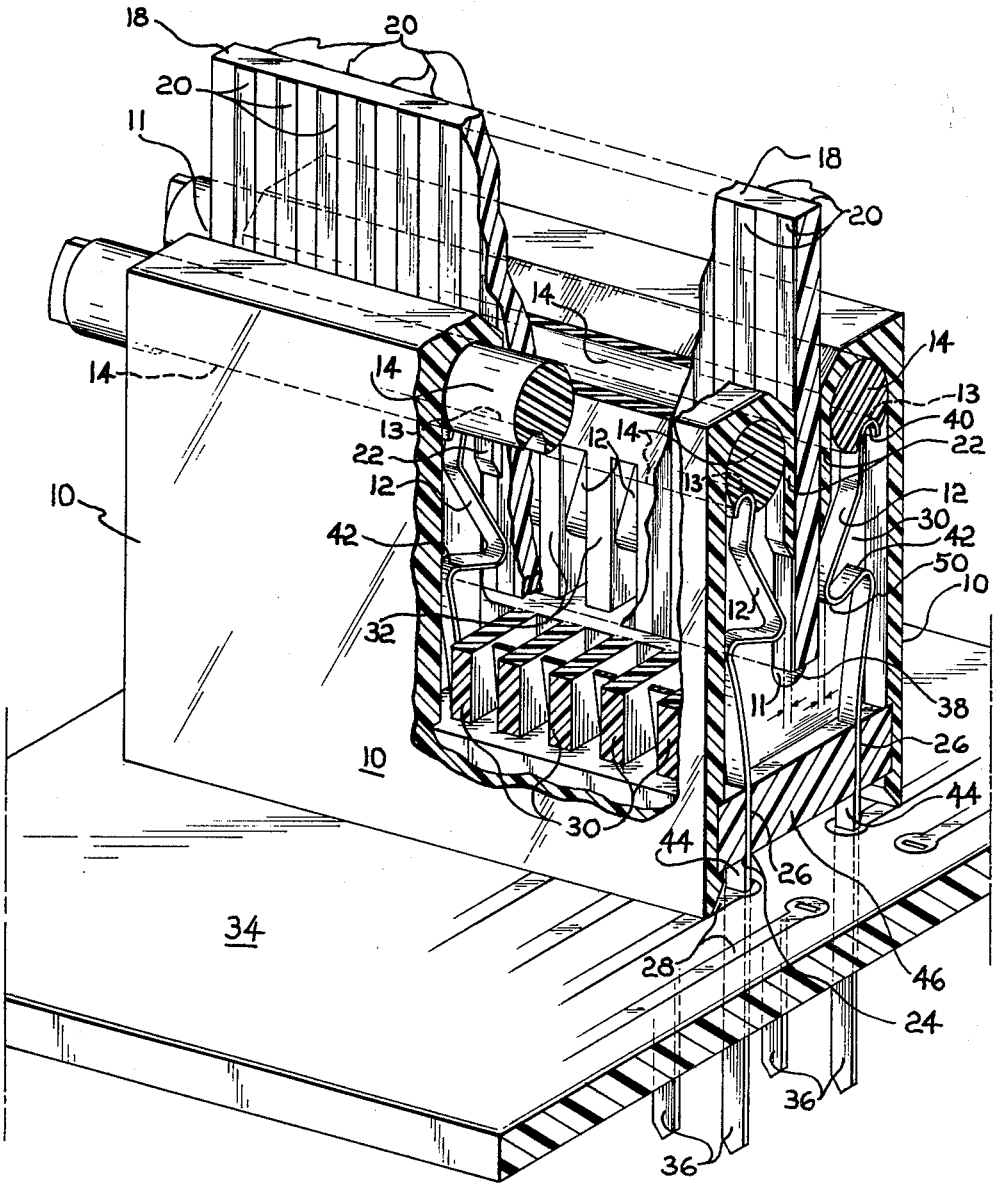
FIG. 1 is a partially cutaway sectional view in perspective of an embodiment involving a single channel in the toggle rod.

Referring to FIG. 1, the housing 10 consists of a molded dielectric plastic material made from reinforced nylon, reinforced polyester or reinforced polyphenylene sulfide. The housing 10 has a slot 11 of appropriate size to receive a circuit board 18. The circuit board can be slid into the connector slot from above or from an open side of the connector. The circuit board has contact strips 20 which will be aligned with the contact springs 12 positioned within the housing. Parallel to the slot 11 of the housing 10 are one or more toggle rods 14. The toggle rod is made from a reinforced nylon, polyester or polyphenylene sulfide which may be the same as the substance from which the housing is made.

The toggle rod of FIG. 1 has a single channel 13 running along its entire length. A plurality of springs 12 are inserted into this channel. Each of the springs 12 is separated from the adjacent spring by a wall 32 in the dielectric housing. The guiding member 22 in the dielectric housing allows for the correct positioning of the printed circuit board 18 as it moves through the slot 11 into the housing 10. A stop 38 near the bottom of the housing prevents the circuit board from continuing its movement beyond the desired position.

The spring has a curved surface on its upper or first end 40 which is a bearing surface in engagement with the channel 13 of the toggle rod 14. This bearing end 40 of the spring 12 rides within the channel 13 of the toggle rod 14 during actuation. The second end of the spring is a fixed end 44 and is inserted into a channel 26 in the bottom of the housing 10, and may exit from the housing through aperture 24. The second end of the spring 44 may be a pluggable electrical contact or a wire wrap that may be soldered to another circuit board or other electrical contact. The intermediate portion of the spring is S-shaped 42 and its outer, upper loop 50 forms the contact surface with the contact strips 20 of the circuit board 18. The spring is made from brass, copper, phosphor-bronze, copper-nickel or other conventional resilient current-carrying substance.

Figures 3A, 3B, 3C:
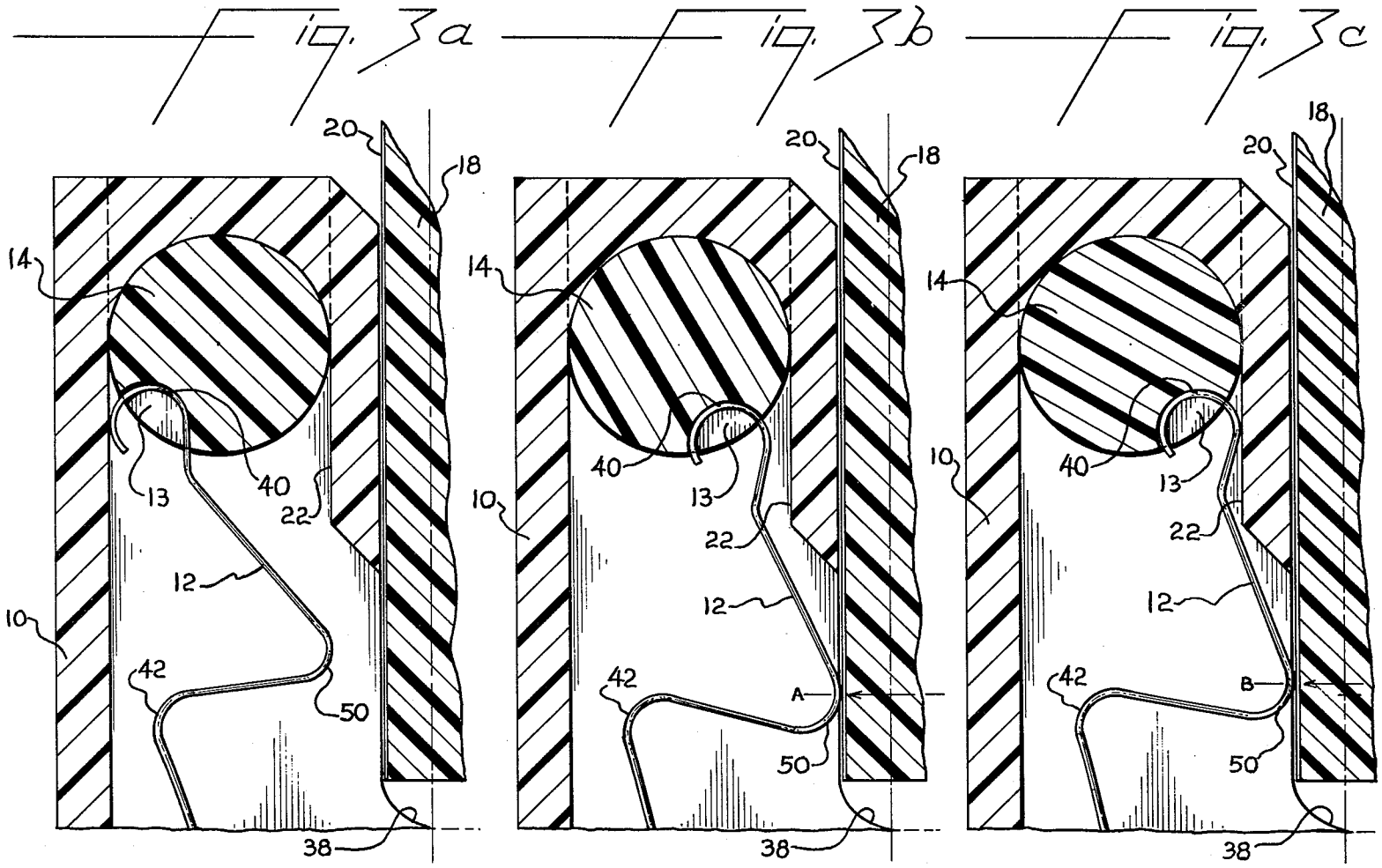
FIGS. 3*a, b, c* is a sectional view of the FIG. 1 embodiment showing several spring positions.

Circular movement of the toggle rod 14 causes the spring 12 to move in a longitudinal direction so that the upper loop 50 of its intermediate portion 42 touches (FIG. 3*b*) the contact strip 20 of the circuit board 18 and thereafter wipes down the surface of the contact strip 20 until such time as the spring moves over center and thereby causes a slight upward movement of the upper loop 50 of the spring (FIG. 3*c*). Reversing the circular motion of the toggle rod 14 causes the intermediate portion 42 of the spring 12 to move in an opposite longitudinal direction so that there is disengagement from the circuit board 18. After moving over center, the spring is locked in the open position, FIG. 3*a*. The circuit board 18 can thereafter be removed from the housing 10 without any substantial frictional force affecting the circuit board 18 or its contact strips 20.

Figure 1A:
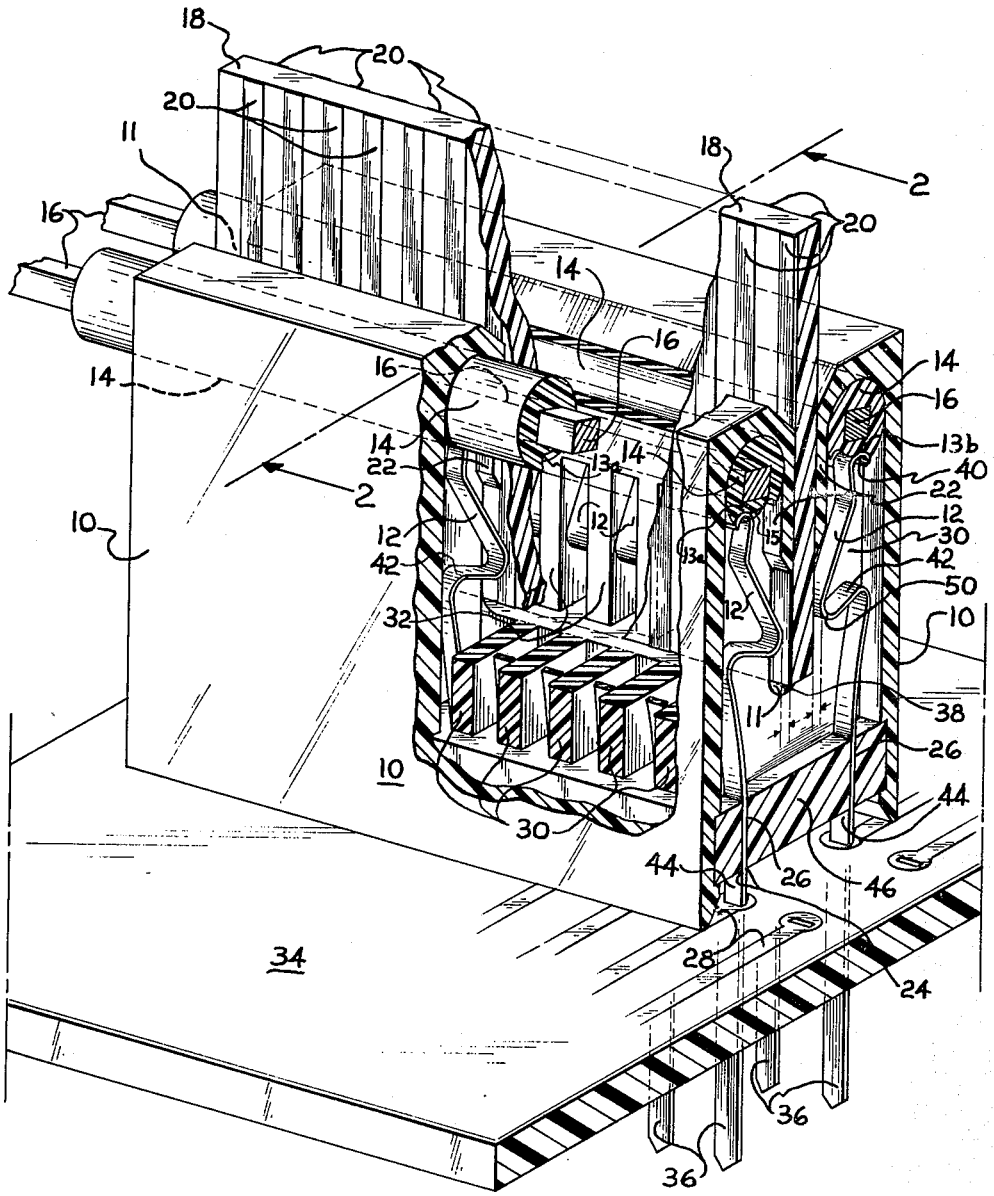
FIG. 1*a* is a partially cutaway sectional view in perspective of another embodiment of the connector of the present invention employing two channels and a plane between the two channels in the toggle rod.
Figure 4A:
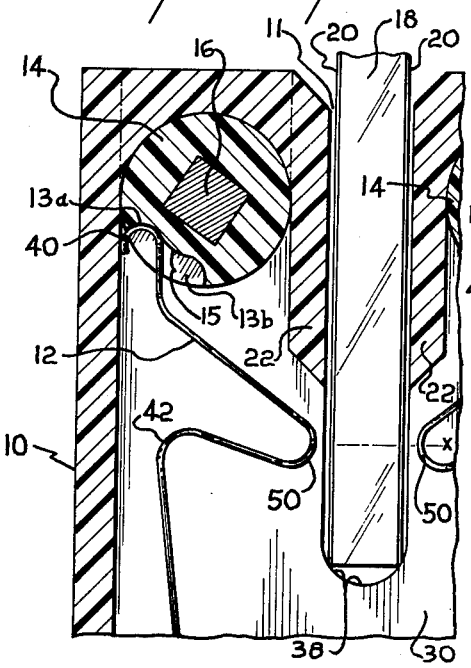
FIGS. 4*a, b, c, d,* and *e* are sectional views of the embodiment shown in FIG. 1*a* showing the several spring positions.
Figure 4B:
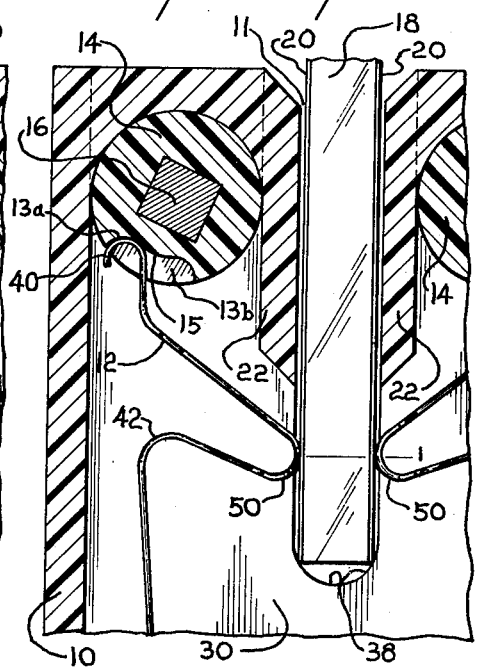
Figure 4C:
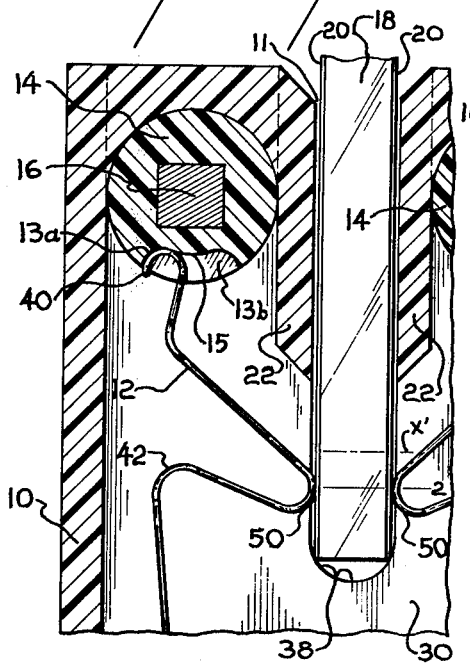
Figure 4D:
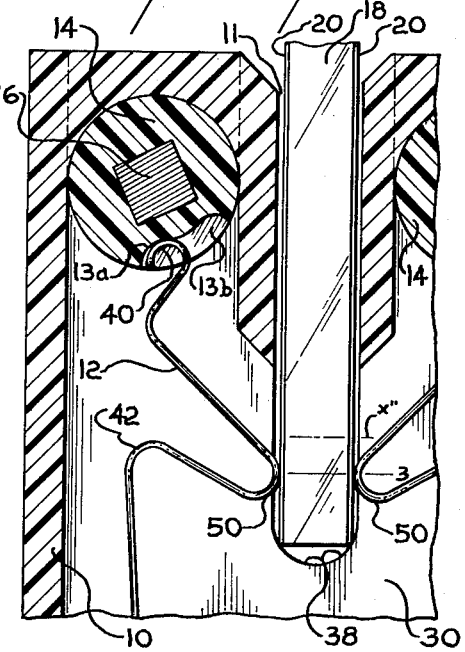
Figure 4E:
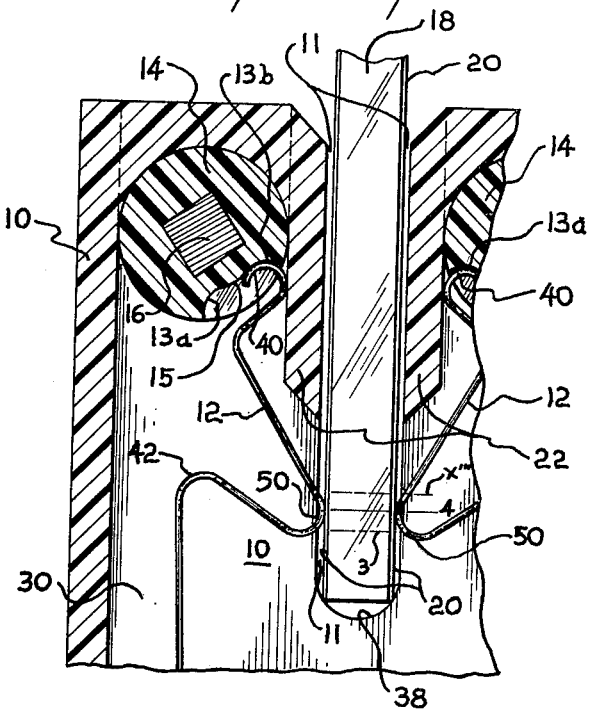

FIG. 1*a* shows an alternate embodiment of the invention. It differs from the FIG. 1 embodiment by having a modified toggle rod. The toggle rod 14 is programmed with two channels 13*a* and 13*b* together with a travel plane 15 between the two channels. Channel 13*a* is designated an activation channel since the bearing end 40 of the spring is located in this channel at the start of the cycle when the upper loop 50 of the intermediate portion 42 of the spring is not touching the circuit board, FIG. 4*a*. As the toggle rod 14 is moved in a circular pattern the spring intermediate portion 42 moves towards the circuit board and after touching the board, FIG. 4*b*, moves downward, FIG. 4*c*, thereby wiping the corresponding contact on the circuit board. As the toggle rod is moved further, the bearing end 40 of the spring moves over the travel plane 15, FIG. 4*d*, and snaps into the channel 13*b*, FIG. 4*e*, to lock in place. There is a slight upward movement of 50 (back wipe) as the spring snaps into the locked position. Reversing this cycle, the toggle rod is moved in the opposite circular direction and this causes the spring bearing end 40 to move back across the plane 15 and snaps into the channel 13*a* as the intermediate portion 42 of the spring moves away from the circuit board. The second end 44 of the spring remains fixed in channel 26 during both cycles.

Figure 5:
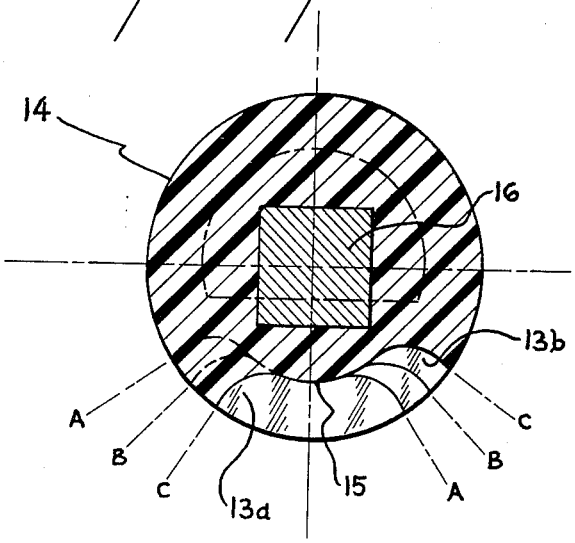
FIG. 5 is a partially sectioned view of the FIG. 1*a* toggle rod showing the programmed spring positions.

The toggle rod channels in this embodiment can be programmed so that a series of springs 12 snap over at different 10° increments (FIG. 5) in the turn of the toggle rod. In this manner, ground, power and signal terminals can make contact at different times as desired and established by the program. This embodiment may require a metal rod such as a stiff steel or rigid aluminum rod 16 to sustain a dielectric programmed changeable cover of the toggle rod. However the programmed rod could be premolded in the desired program configuration and therefore would not require a rod.

Figure 1B:
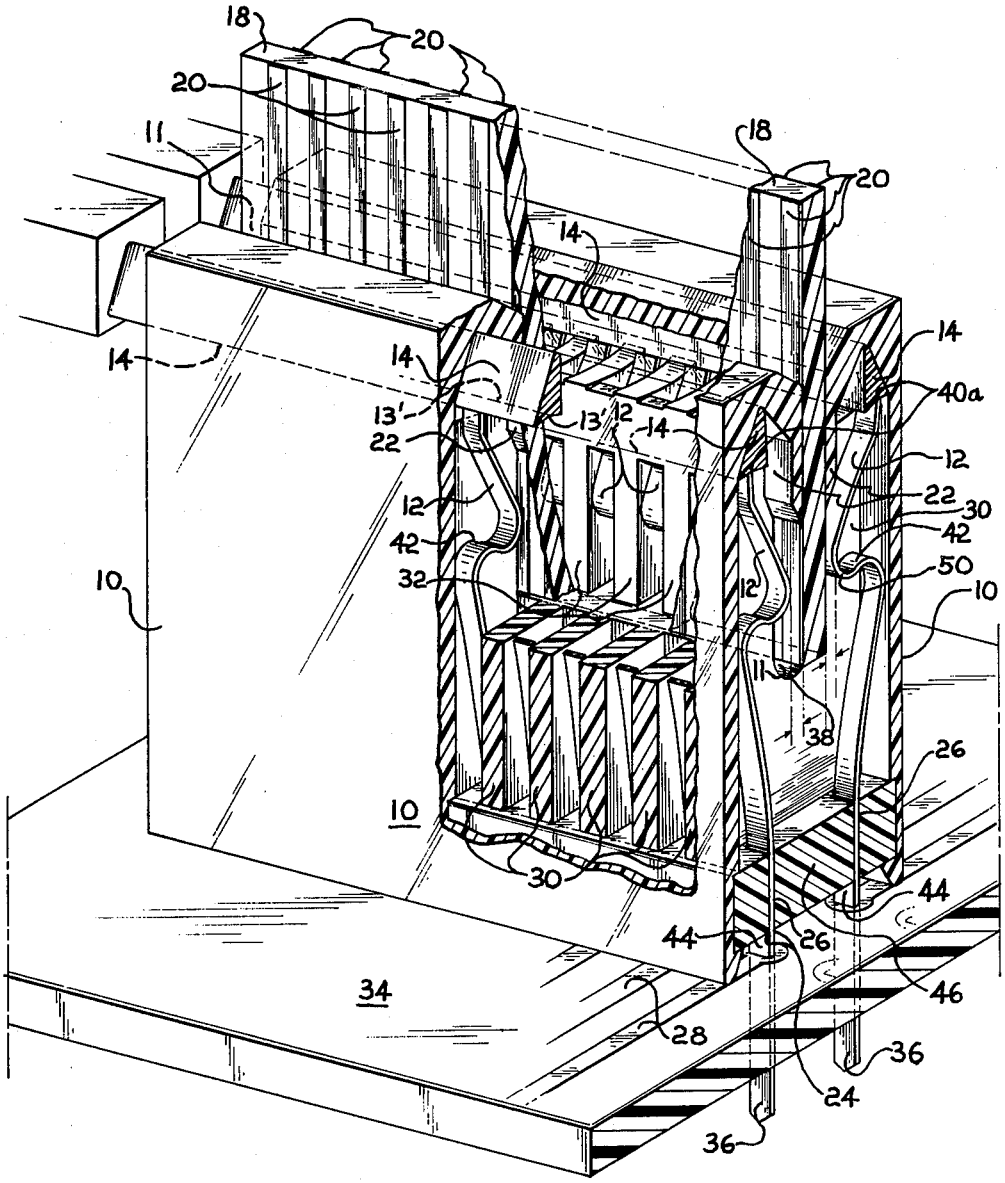
FIG. 1*b* is a partially cutaway sectional view in perspective of still another embodiment of the connector of the present invention employing a pointed first end of the spring inserted into a groove in the toggle rod.
Figure 2:
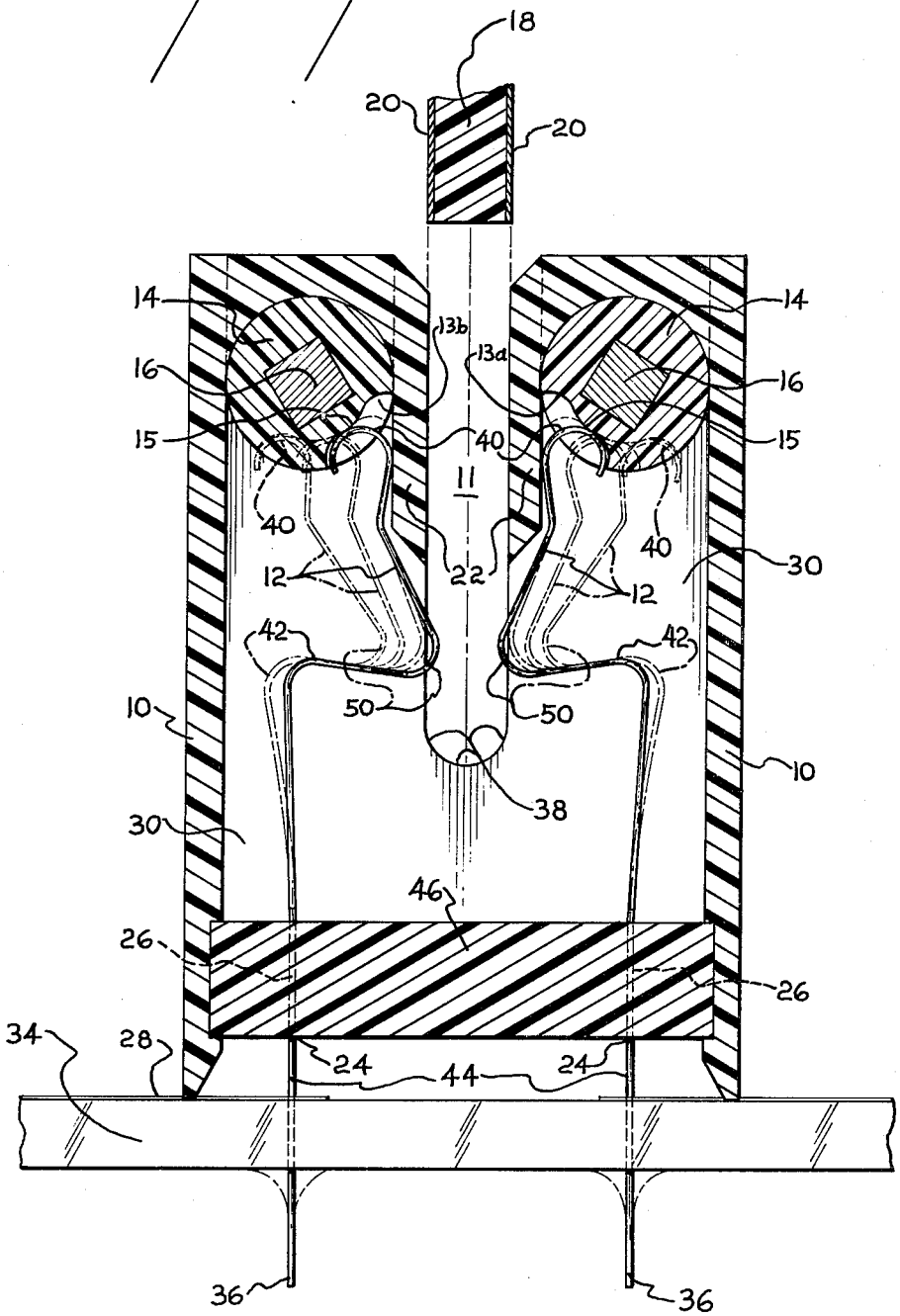
FIG. 2 is a sectional view along line 2—2 of FIG. 1*a*.

FIG. 1*b* shows still another embodiment which differs from the previous devices only in the top portion or first end of the spring 12 and the shape of the toggle rod. In this embodiment the toggle rod has a channel 13, in which the first end 40*a* of the spring 12 rides. Movement of the toggle rod in a circular path, moves the spring over center and causes the intermediate portion of the spring 42 to contact and wipe the circuit board contact strip. Reversing the circular path of the toggle rod causes the spring to snap over center in the opposite direction and causes disengagement of the intermediate portion of the spring from the circuit board.

I claim:

1. A zero insertion force type connector for electrically engaging a printed circuit board, comprising:

(1) a dielectric housing having an elongated slot for receiving a printed circuit board and means for guiding said board into the interior of said housing, (2) at least one toggle rod parallel to said slot in said housing; and (3) a plurality of elongated curved uniformly resilient spring metal terminals having first and second ends and an intermediate portion, said first end of each terminal movable in and retained within a groove in said toggle rod, said second end of each terminal extending through a separate channel within said housing and being available for electrical contact with another electrical device, said intermediate portion of each said terminal being engageable and disengageable from electrical contact with said circuit board in the interior of said housing by rotation of said toggle rod and in response to movements of said first end of the terminal over center in the groove of said toggle rod.

2. A connector according to claim 1 wherein the first end of each spring moves within a single channel in the toggle rod.

3. A connector according to claim 1 wherein the first end of each spring engages and moves over a travel plane between two channels in the toggle rod upon rotation of the toggle rod.

4. A connector according to claim 1 wherein the intermediate portion of the springs wipes the surface of the circuit board as the toggle rod is rotated to lock the springs in the closed position.

5. A connector according to claim 1 wherein the toggle rod is a molded dielectric plastic having a travel plane between two channels in its outer surface to actuate springs engaging with said toggle rod in a predetermined programmed order.

6. A connector according to claim 1 wherein the toggle rod consists of a metal rod encased in at least one dielectric programmed cover.

* * * * *